US006909400B2

(12) United States Patent
Vothknecht et al.

(10) Patent No.: US 6,909,400 B2
(45) Date of Patent: Jun. 21, 2005

(54) ALLROUND AERIAL ARRANGEMENT FOR RECEIVING TERRESTRIAL AND SATELLITE SIGNALS

(75) Inventors: Marco Vothknecht, Rosenheim (DE); Peter Prassmayer, Grosskarolinenfeld (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/476,692

(22) PCT Filed: Feb. 27, 2003

(86) PCT No.: PCT/EP03/02027

§ 371 (c)(1),
(2), (4) Date: Dec. 4, 2003

(87) PCT Pub. No.: WO03/075394

PCT Pub. Date: Sep. 12, 2003

(65) Prior Publication Data

US 2004/0140940 A1 Jul. 22, 2004

(30) Foreign Application Priority Data

Mar. 7, 2002 (DE) ..... 102 09 996

(51) Int. Cl.[7] ..... H01Q 1/38; H01Q 21/00
(52) U.S. Cl. ..... 343/700 MS; 343/725
(58) Field of Search ..... 343/767, 769, 343/700 MS, 702, 725, 715

(56) References Cited

U.S. PATENT DOCUMENTS

| | | | | |
|---|---|---|---|---|
| 4,700,197 A | | 10/1987 | Milne | 343/837 |
| 6,147,652 A | | 11/2000 | Sckine | 343/702 |
| 6,160,512 A | * | 12/2000 | Desclos et al. | 343/700 MS |
| 6,172,646 B1 | * | 1/2001 | Kawahata et al. | 343/702 |
| 6,232,925 B1 | * | 5/2001 | Fujikawa | 343/702 |
| 6,329,954 B1 | | 12/2001 | Fuchs et al. | 343/725 |
| 6,380,903 B1 | * | 4/2002 | Hayes et al. | 343/725 |
| 6,452,558 B1 | * | 9/2002 | Saitou et al. | 343/725 |
| 6,507,318 B2 | * | 1/2003 | Ito et al. | 343/702 |
| 6,529,168 B2 | * | 3/2003 | Mikkola et al. | 343/702 |
| 6,646,606 B2 | * | 11/2003 | Mikkola et al. | 343/700 MS |
| 2002/0018026 A1 | | 2/2002 | Noro | |

FOREIGN PATENT DOCUMENTS

| | | |
|---|---|---|
| DE | 31 29 045 A1 | 10/1982 |
| DE | 202 10 312 U1 | 10/2002 |
| EP | 1 100 148 A1 | 5/2001 |
| EP | 1 193 794 A2 | 4/2002 |
| WO | 96/35241 | 11/1996 |

OTHER PUBLICATIONS

Japanese Abstract No. 10246815 A; Tatsuyoshi et al; "Multiple–Fequency Composite Antenna"; Sep. 14, 1998.
McCarrick; "A Combination Monopole/Quadrifilar Helix Antenna for S–Band Terrestrial/Satellite Applications"; Microwave Journal, May 2001, pp. 330–334.

* cited by examiner

*Primary Examiner*—Tan Ho
(74) *Attorney, Agent, or Firm*—Nixon & Vanderhye P.C.

(57) ABSTRACT

An improved combination antenna for receiving terrestrial, in particular vertically polarized signals, and for receiving in particular circular polarized satellite signals in accordance with the SDARS services, preferably in a 2.3 GHz band, having the following features:

a monopole arrangement (7) is provided for receiving terrestrial signals, a satellite receiving antenna is provided for receiving circular polarized satellite signals, only a single monopole (7) is provided, and the satellite receiving antenna is in the form of a patch antenna (9).

18 Claims, 3 Drawing Sheets

ALLROUND AERIAL ARRANGEMENT FOR RECEIVING TERRESTRIAL AND SATELLITE SIGNALS

This application is the U.S. national phase of international application PCT/EP03/02027 filed 27 Feb. 2003, which designated the U.S. PCT/EP03/02027 claims priority to DE Application No. 102 09 996.0 filed 07 Mar. 2002. The entire contents of these applications are incorporated herein by reference.

The invention relates to a combination antenna for receiving terrestrial and satellite signals, as claimed in the precharacterizing clause of claim 1.

BACKGROUND OF THE INVENTION

A satellite-based radio system which operates with only a small number of satellites in distributed orbits is used, in particular in the USA. The aim is to offer antennas for this satellite-based radio system which have to provide the same minimum gain even at low elevation angles from 25° up to an elevation of 90°.

At the same time, the combination antennas are also intended to be suitable for receiving terrestrial signals.

The corresponding systems are also known in the specialist field by the expression SDARS services, which transmit in the 2.3 GHz band. The satellite signals are in this case transmitted with circular polarization.

In order to take account of these extreme conditions and to provide a high antenna gain even at low elevations of 25° or more, continuous attempts have been made to take account of these extreme requirements by specially adapted antenna structures.

A special antenna system has thus become known on the USA market, which contains a cruciform dipole that is formed from a flat material and thus forms four quadrants which are separated from one another by the dipole walls. A separate, vertically extending monopole is then arranged in each quadrant, via which the terrestrially transmitted vertically polarized signals can be received. However, the overall complexity of the antenna is considerable since, in particular, appropriate feed networks are also required in order to feed the cruciform dipole and the four monopoles.

The publication "A Combination Monopole/Quadrifilar Helix Antenna For S-Band Terrestrial/Satellite Applications" in the Microwave Journal May 2001 likewise describes a combination antenna which is intended to be suitable for satellite reception on the basis of the SDARS services in the USA. This antenna is likewise intended to have a good antenna gain and a sufficiently good axis ratio even at elevation angles of around 25°. These antennas have a rod monopole which extends vertically, and around which a helix is arranged.

Finally, however, EP 1 100 148 A1 also discloses a correspondingly circular polarized cross dipole antenna, which has two pairs of inverted V-shaped dipole antenna arrangements. These antenna dipole elements are curved like an inverted "V".

SUMMARY OF THE INVENTION

In contrast, the object of the present invention is to provide an improved antenna system in particular for the SDARS services in the USA, which makes it possible to receive not only terrestrial, particularly vertically polarized, signals, but also to receive in particular circular polarized satellite signals, with the satellites not only being positioned in the elevation angle range around 90° but also, in some cases, also being positioned low above the horizon, at an elevation of around 25°.

According to the invention, the object is achieved on the basis of the features specified in claim 1.

Advantageous refinements of the invention are specified in the dependent claims.

If the normal specifications of the system operators are taken into account for such difficult reception conditions, then it is immediately evident from them that, in the opinion of the overall specialist world, only specially developed combination antennas can take account of the desired requirements.

It is therefore even more surprising that it has not only been possible to comply with the required boundary conditions, but to exceed them, with the solution according to the invention.

The combination antenna according to the invention on the one hand has a monopole for receiving terrestrial, in particular vertically polarized, signals. This monopole may be designed in various ways. However, in particular, the antenna according to the invention is in the form of a patch antenna, which is known per se.

However, it has long been known in the specialist world that patch antennas achieve their optimum function at the zenith, that is to say at an elevation of 90°. The antenna gain reaches its maximum at this point, with the axis ratio of circular polarized patch antennas conversely reaching a minimum.

However, the antenna gain and axis ratio parameters become continuously worse in the direction of lower elevation angles.

It was therefore always expected that patch antennas would be completely unsuitable in particular for receiving satellite signals on the basis of the SDARS service in the USA. No corresponding proposals using patch antennas have therefore become known.

It must therefore be regarded as being extremely surprising that the combination antenna according to the invention, including a patch antenna element, makes it possible to achieve optimum values with regard to the antenna gain on the one hand and the axis ratio on the other hand even at low elevation angles of 25°, with these parameter values being comparable to the values for the antenna gain and axis ratio as can be expected at an elevation of 90°!

In one particularly preferred embodiment of the invention, a monopole which extends in the form of a vertical rod is in this case used in addition to the patch antenna as an antenna element for receiving terrestrial signals, as is known per se from the prior art.

In order to allow construction with a low height, an inverted F antenna, for example composed of wire or the like, is also preferably used, and can be arranged on a substrate, for example on a printed circuit board.

However, a printed circuit for example on a printed circuit board can just as well be used as a monopole, and can be arranged vertically on a substrate in the form of a further printed circuit board. A stripline conductor for the monopole can be formed on this additional vertically extending printed circuit board, which is provided for the monopole, and can also run in an S-shape or meandering shape in the form of a square-wave pulse in order to reduce the physical height.

However, in one particularly preferred embodiment, an antenna element having a cavity is used in whose top face, for example in the form of a metal plate, an annular slot is provided. The annular slot in this case acts as a monopole.

In order to reduce the overall physical height, the cavity, that is to say the cavity that is located underneath the slot, is preferably filled with a dielectric, for example with glass, ceramic or the like. Since the dielectric constant $\epsilon_R$ of glass has, for example, a value of around 9 and that of ceramic has a value of around 20 to 30, this leads to the cavity size being reduced to one third when using glass or to one fifth when using ceramic. It is thus possible to produce combination antennas with a very small physical height for receiving SDARS services.

BRIEF DESCRIPTION OF THE DRAWINGS

Further advantages, details and features of the invention will become evident in the following text from the exemplary embodiments which are illustrated in the drawings, in which, in detail.

DETAILED DESCRIPTION OF THE INVENTION

Figure 1:
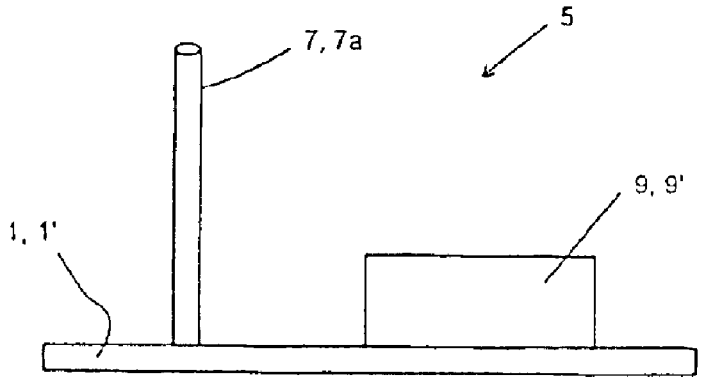
FIG. 1 shows a schematic side view of an antenna according to the invention.

FIG. 1 shows a combination antenna 5 for reception of SDARS services (which are normally transmitted in the 2.3 GHz band) in the USA, preferably in the form of a printed circuit board 1' on a substrate 1.

A monopole 7 is provided vertically on the substrate 1, that is to say a rod monopole 7*a* in the illustrated exemplary embodiment. A patch antenna 9 is formed on the substrate 1 on the side, alongside the monopole 7*a*. Both antenna elements 7 and 9 are fed in a known manner.

The patch antenna 9 is preferably in the form of a ceramic patch antenna 9'. Since the mechanical size of the patch antenna 9 depends on the resonant frequency on the one hand and on the dielectric constant of the material to be used on the other hand, with a microwave ceramic normally being used [lacuna]. Since the patch antenna is intended to be used to receive circular polarized electromagnetic waves in the 2.3 GHz band, and the physical mechanical size of the patch antenna in this case depends, as mentioned, on the resonant frequency, this results in a comparatively physically small patch antenna 9 and, surprisingly in this case, the capability of patch antenna 9 such as this to comply with the stringent requirements in accordance with the normal system specifications of the system operators, on the basis of which the antenna gain should be greater than 3 dBic in the elevation range between 25° and 90°.

Figure 2:
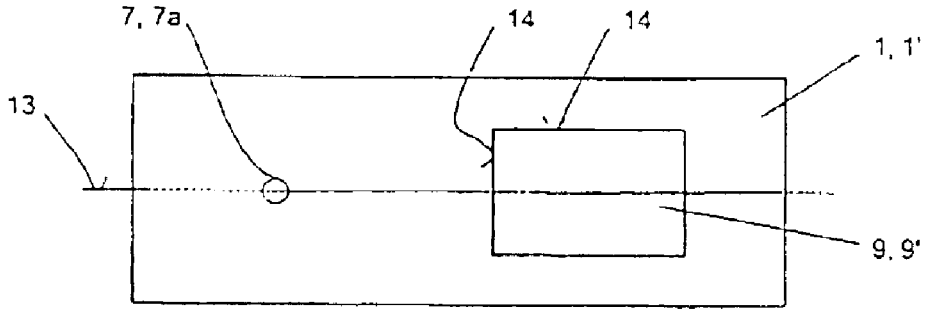
FIG. 2 shows a plan view of the exemplary embodiment as shown in FIG. 1 of the antenna according to the invention.

FIG. 2 shows the plan view of the antenna arrangement shown in FIG. 1. This shows that the monopole is arranged on a vertical central longitudinal plane 13, which runs parallel or at right angles to the side boundaries 14 of the patch antenna 9, which is square in a plan view.

Figure 3:
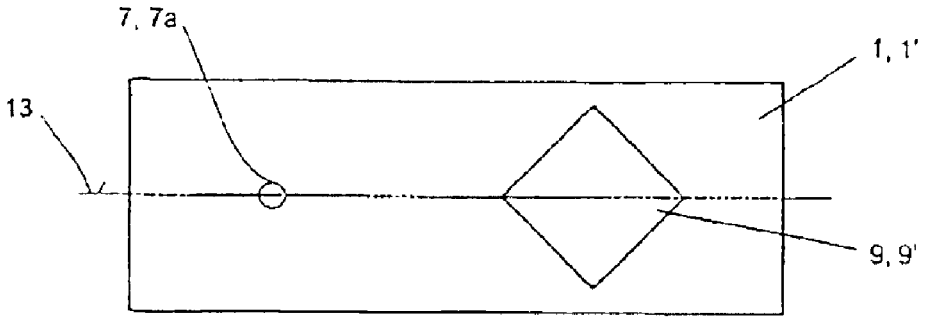
FIG. 3 shows a plan view, comparable to that in FIG. 2, relating to a slightly modified exemplary embodiment.

The exemplary embodiment in FIG. 3 shows only schematically that the patch antenna can also be arranged rotated through 45° with respect to the exemplary embodiment shown in FIGS. 1 and 2, so that the vertically extending monopole 7 (which, by way of example, is in the form of a rod in the illustrated exemplary embodiment) lies on a vertical central plane of symmetry 13 which runs diagonally through the patch antenna 9.

Figure 4:
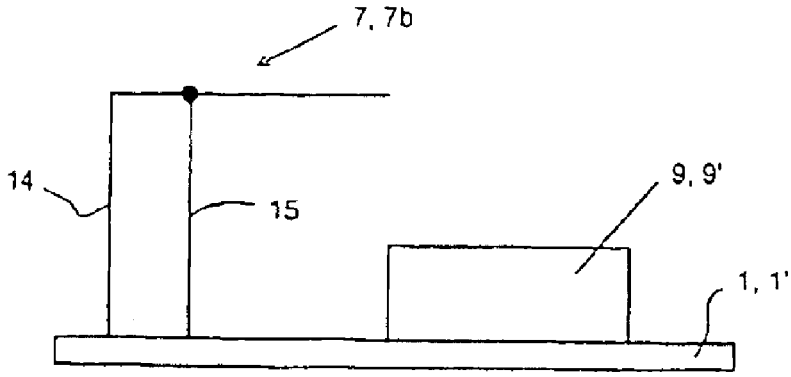
FIG. 4 shows a further modified exemplary embodiment relating to an inverted F antenna as a monopole.

FIG. 4 shows only a schematic side view, illustrating that an inverted F antenna 7*b* can also be used instead of a rod monopole 7, one limb 14 of which inverted F antenna 7*b* is, connected to ground on the substrate 1, 1' while, in contrast, the monopole is fed with a high impedance via an offset feed line 15.

Figure 5:
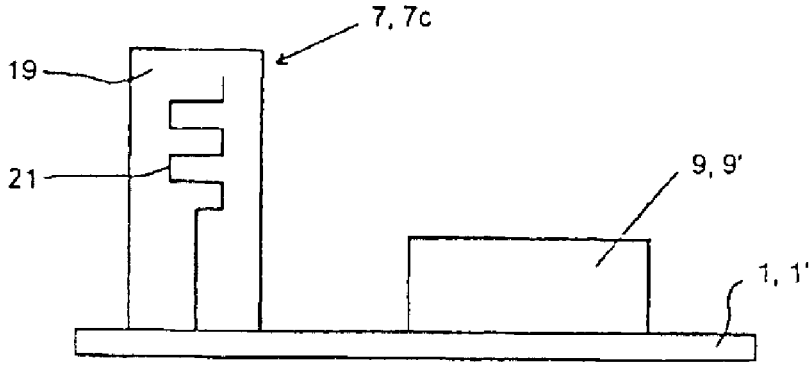
FIG. 5 shows a stripline conductor monopole antenna for a further modified exemplary embodiment.

However, as is shown in FIG. 5, a monopole 7*c* in the form of a stripline conductor can also be used instead of the monopole 7*a* or 7*b*, and is fitted to a substrate, for example to a further separate printed circuit board 19. In order to reduce the physical height, the stripline conductor 21 may in this case be arranged in a meandering shape or running in the form of a square-wave pulse on the substrate or on the printed circuit board 19.

Figure 6:
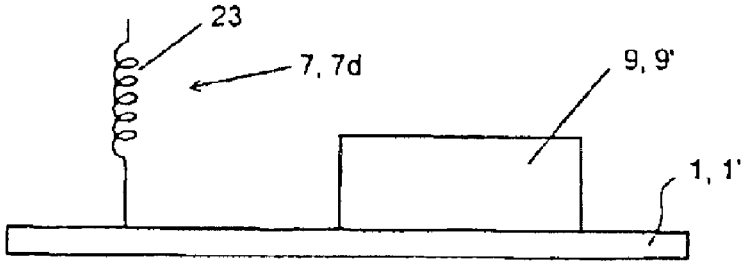
FIG. 6 shows another modified exemplary embodiment relating to a monopole.

The exemplary embodiment shown in FIG. 6 uses a monopole 7*d*, in which the rod monopole is in the form of a coiled former 23 at the end remote from the printed circuit board 1'.

Figure 7:
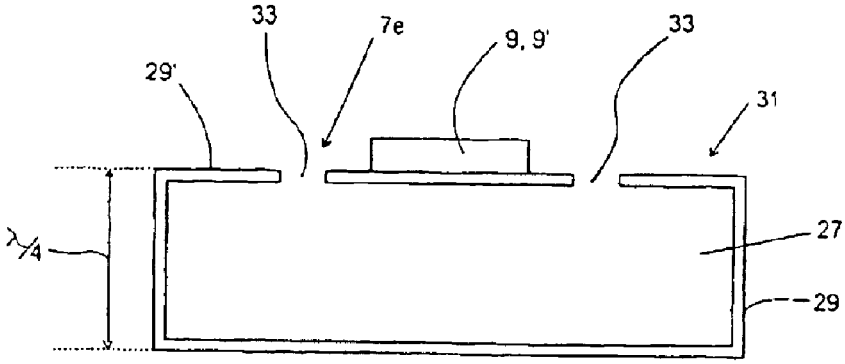
FIG. 7 shows a plan view of a further modified exemplary embodiment of a combination antenna with an annular slot instead of a monopole antenna element.
Figure 8:
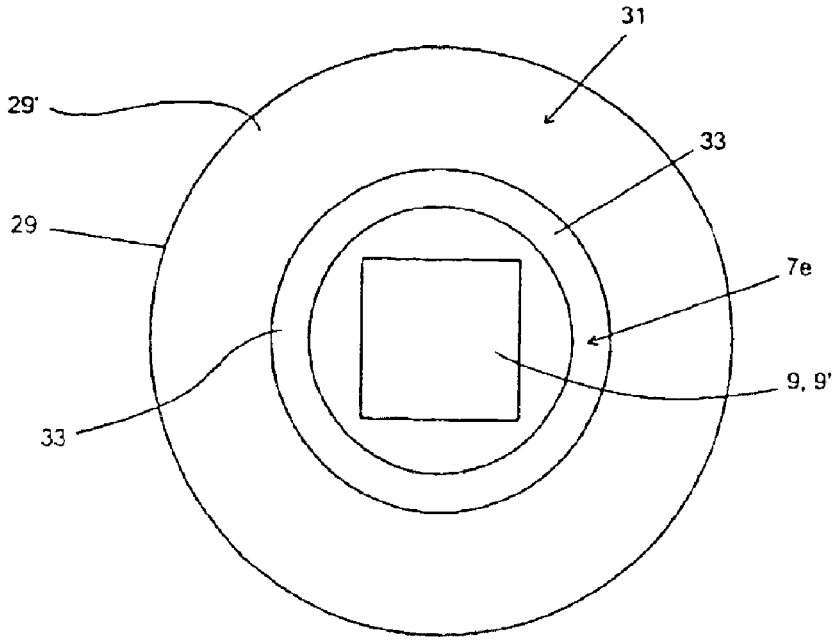
FIG. 8 shows a cross-sectional illustration relating to the exemplary embodiment shown in FIG. 7.

In one particularly preferred embodiment shown in FIGS. 7 and 8, a combination antenna is used which has a cavity 27 that is formed by a housing 29 which bounds the cavity 27. The housing 29 can preferably be provided with a metallic surface.

An annular slot 33 is incorporated in the appropriate housing wall 29' on the top face 31.

In the interior of the annular slot 33, the patch antenna 9 is in a position on the top face 31, that is to say on the upper housing wall 29', and is in this case fed in a known manner. The annular slot 33 runs around the patch antenna 9 in the upper housing wall 29', and its polar diagram is comparable to that of a monopole.

As indicated in FIG. 8, the physical height corresponds to $\lambda/4$ of the operating mid-frequency. Thus, if the antenna is operated in the 2.3 GHz band, this results in a physical height of approximately 5 cm.

However, this physical height can effectively be reduced by filling the cavity 27 with a dielectric. Glass or ceramic may be used, for example, as a suitable dielectric, thus allowing the mechanical dimensions to be reduced considerably.

Since glass, for example, has a dielectric constant of around 9, this leads to the physical height being reduced by a factor of 3. If ceramic is used as the dielectric having, for example, a dielectric constant of 20 to 30, this leads to the physical height being reduced by a factor of 5.

It is thus evident from the described design that the present invention is also suitable in a highly surprising manner for reception of programs which are transmitted by satellites located at a comparatively low angle above the horizon. In this case, it is highly surprising that a patch antenna can achieve such a high antenna gain when the satellite signals are transmitted at an angle of less than 50°, in particular even less than 40° or even less than 30°, namely in particular even around 25°. This is surprising, because, as is known, patch antennas achieve their maximum antenna gain only when the signals are transmitted from the zenith, or are received in the zenith direction, that is to say aligned at right angles to the plane of the horizontal. All antenna systems which have become known in the past and were intended to be suitable for a comparable problem, in particular for receiving SDARS services, therefore invariably proposed solutions which were deliberately not based on patch antennas.

What is claimed is:

1. A combination antenna for receiving terrestrial, vertically polarized, signals and for receiving circularly polarized satellite signals in accordance with the SDARS services, comprising:

a single monopole arrangement that receives terrestrial signals, a satellite receiving antenna that receives circularly polarized satellite signals, the satellite receiving antenna comprising a patch antenna receiving SDARS services signals which are transmitted to a low elevation angle of 25°.

2. The combination antenna as claimed in claim 1, further including a printed circuit board substrate, wherein both the monopole arrangement and the patch antenna are formed and connected on the printed circuit board substrate.

3. The combination antenna as claimed in claim 1, wherein the monopole arrangement comprises a rod monopole.

4. The combination antenna as claimed in claim 3 further including a substrate, and wherein the rod monopole has first and second opposite ends, said first end being disposed on said substrate, said rod monopole further comprising a coil former at the second end thereof opposite the substrate.

5. The combination antenna as claimed in claim 1, wherein the monopole arrangement comprises an inverted F antenna.

6. The combination antenna as claimed in claim 1, wherein the monopole arrangement comprises a stripline conductor.

7. The combination antenna as claimed in claim 6, further including a substrate, and wherein the stripline conductor runs in a meandering shape on the substrate.

8. The combination antenna as claimed in claim 1, wherein the monopole arrangement is arranged on a vertical central longitudinal plane which passes through the patch antenna, with the vertical central longitudinal plane being aligned at right angles or parallel to the side boundary edges of the patch antenna.

9. The combination antenna as claimed in claim 1, wherein the monopole arrangement is arranged on a vertical central longitudinal plane which passes through the diagonal of the patch antenna.

10. The combination antenna as claimed in claim 1 wherein the antenna, in use, receives SDARS services and/or receives signals transmitted by satellites, which are still receivable at an elevation angle of about 25°.

11. The combination antenna as in claim 1 further including a printed circuit board, and wherein said monopole arrangement comprises a printed structure formed on said printed circuit board.

12. The combination antenna of claim 1 wherein said patch antenna receives said SDARS services signals transmitted in a 2.3 GHz band.

13. A combination antenna for receiving terrestrial vertically polarized signals and for receiving circular polarized satellite signals in accordance with the SDARS services in a 2.3 GHz band, comprising:

a monopole for receiving terrestrial signals, a satellite receiving antenna for receiving circular polarized satellite signals, wherein only a single monopole is provided, and wherein the satellite receiving antenna is in the form of a patch antenna, wherein an annular slot is formed in one housing wall of a housing which surrounds a cavity.

14. The combination antenna as claimed in claim 13, wherein the patch antenna is arranged within the annular slot.

15. The combination antenna as claimed in claim 13, wherein the cavity is filled with a dielectric.

16. The combination antenna as claimed in claim 15, wherein the dielectric is glass or ceramic.

17. A combination antenna comprising:

a housing defining a cavity therein, said housing comprising a wall defining an annular slot therein;

a patch antenna arranged within the annular slot, the patch antenna receiving circularly polarized SDARS satellite signals; and a monopole antenna element provided within or on said housing, said monopole antenna element receiving terrestrial vertically polarized signals.

18. A combination antenna comprising:

a substrate;

a monopole mounted to said substrate, said monopole receiving vertically polarized terrestrial signals; and a patch antenna mounted to said substrate, said patch antenna receiving, with gain, circularly polarized 2.3 GHz band satellite digital audio radio services (SDARS) signals transmitted at a low angle above the horizon of 25 degrees.

* * * * *